US010954040B2

(12) United States Patent
Lo Piccolo et al.

(10) Patent No.: US 10,954,040 B2
(45) Date of Patent: Mar. 23, 2021

(54) PULL-OFF CLOSURE FOR CONTAINERS

(71) Applicant: PELLICONI & C. S.p.A., Ozzano Dell'Emilia (IT)

(72) Inventors: Antonio Lo Piccolo, Battipaglia (IT); Doriano Naldi, Ozzano Dell'Emilia (IT)

(73) Assignee: PELLICONI & C. S.P.A., Ozzano Dell'emilia (IT)

( * ) Notice: Subject to any disclaimer, the term of this patent is extended or adjusted under 35 U.S.C. 154(b) by 69 days.

(21) Appl. No.: 16/342,625

(22) PCT Filed: Oct. 20, 2017

(86) PCT No.: PCT/IB2017/056534
§ 371 (c)(1),
(2) Date: Apr. 17, 2019

(87) PCT Pub. No.: WO2018/078498
PCT Pub. Date: May 3, 2018

(65) Prior Publication Data

US 2019/0263570 A1 Aug. 29, 2019

(30) Foreign Application Priority Data

Oct. 28, 2016 (IT) ..... 102016000109454

(51) Int. Cl.
*B65D 41/42* (2006.01)
*B65D 51/24* (2006.01)
*B65D 53/04* (2006.01)

(52) U.S. Cl.
CPC ..... *B65D 41/425* (2013.01); *B65D 41/42* (2013.01); *B65D 51/243* (2013.01); *B65D 53/04* (2013.01); *B65D 2401/20* (2020.05)

(58) Field of Classification Search
CPC ..... B65D 41/3428; B65D 41/3409; B65D 41/425; B65D 41/42; B65D 51/243; B65D 51/24; B65D 53/04
(Continued)

(56) References Cited

U.S. PATENT DOCUMENTS 1,604,063 A * 10/1926 Miller ..... B65D 51/243 215/251
2,018,061 A * 10/1935 Gillen ..... B65D 41/40 215/325
(Continued)

FOREIGN PATENT DOCUMENTS

CN 104555044 A 4/2015
CN 105531196 A 4/2016
(Continued)

OTHER PUBLICATIONS

Chinese Office Action dated Mar. 3, 2020 from counterpart Chinese App No. 201780065895.9.
(Continued)

*Primary Examiner* — Robert J Hicks
(74) *Attorney, Agent, or Firm* — Shuttleworth & Ingersoll, PLC; Timothy J. Klima

(57) ABSTRACT

A pull-off closure for containers having an opening whose end portion defines an annular collar projecting externally; the closure including: an upper portion shaped in the form of a shell having an upper face from which extends a collar, which can be turned over to abut on the annular collar of the container, during capping of the container, the upper face and the collar forming, at their connection, an annular edge; lines of weakness formed on the upper face and on the collar forming an opening strip which extends in a tab extending beyond the collar; a gripping element which can be associ-
(Continued)

ated with the tab, wherein the lines of weakness extend on the collar outside the annular edge.

7 Claims, 3 Drawing Sheets

(58) Field of Classification Search
USPC ..... 215/256, 254, 253, 250, 325, 324, 316; 220/270, 266, 265, 310.1, 309.1
See application file for complete search history.

(56) References Cited

U.S. PATENT DOCUMENTS 2,068,444 A * 1/1937 Breckenridge ..... B65D 51/243 215/254
3,937,349 A * 2/1976 Hsu ..... B65D 41/42 215/254
4,003,488 A * 1/1977 Moller ..... B65D 41/42 215/254
4,564,116 A * 1/1986 Prohaska ..... B65D 41/44 215/256
4,768,667 A 9/1988 Magnusson
6,164,472 A 12/2000 Folchini
2016/0207671 A1* 7/2016 Okubo ..... B65D 53/02

FOREIGN PATENT DOCUMENTS

EP 3037361 A1 6/2016
GB 1561073 A 2/1980
JP 2003191982 A 7/2003
WO 2015025737 A1 2/2015

OTHER PUBLICATIONS

International Search Report and Written Opinion dated Jan. 18, 2018 for counterpart PCT Appllication No. PCT/IB2017/056534.

* cited by examiner

PULL-OFF CLOSURE FOR CONTAINERS

TECHNICAL FIELD

This invention relates to a pull-off closure for containers.

More specifically, this invention relates to the closures of containers consisting of bottles (normally made of glass) which have, at the end portion of their neck, an annular collar projecting externally.

BACKGROUND ART

The most commonly known solution for these closures comprises the classic crown cap, that is, the closure having a circular portion from which extends a series of teeth designed to close, during capping, beneath the above-mentioned protruding collar. In this case, the protruding collar is made in a continuous fashion and in order to remove the cap it is necessary have a suitable device or tool, universally known, which forces a plurality of teeth from the bottom, deforming in this way the circular portion and allowing the uncoupling of the cap from the bottle.

The crown cap normally has 19 teeth, in its standard configuration.

In order to overcome the above-mentioned problem of the opening, designs have been developed directed always to the use of a crown cap, but coupled with bottles having, at the upper edge of the neck, a series of threads instead of the continuous edge, as mentioned above.

In this case, the crown cap should have operated, when opening, like a twist-off closure. It was therefore necessary to increase the number of teeth (increasing them, for example, to 29) in order to avoid injuries to the user during opening of the bottle and rotation of the cap; see patent publication U.S. Pat. No. 6,164,472 in the name of the same Applicant.

A further road in the path of facilitated manual opening has been that of the tear-off closure, as may be seen in patent publication U.S. Pat. No. 4,768,667.

In this solution, the closing comprises an upper shell-shaped portion closed by an upper face and from which extends a collar which is, during capping, turned over and closed under the annular collar of the neck of the bottle.

This collar is connected to (in a single body or associated with it) a tab or gripping ring which extends perpendicularly to the upper face of the shell. The tongue or ring, with the bottle closed, adjoins the neck of the bottle.

Lines of weakness are made at both the collar and the upper surface of the shell, which allow, when the ring is gripped by the user and moved upwards, an initial breakage of the collar, followed by a partial breakage of the upper surface, along the above-mentioned lines of weakness.

This partial opening thereby allows the release of the closure, in its entirety, from the neck of the bottle.

This type of closure comprises, at least as regards the shell, the use of aluminium.

The partiality of the lines of weakness and their geometry are also designed to prevent a dividing of the cap which, even in the configuration after pulling off, remains configured in the form of a single body.

Inside the shell, on its inner face, is positioned a seal which comes into contact with the free edge of the neck of the bottle. This seal is made by pressing operations by means of a punch appropriately shaped and acting on a small volume of plastic material brought to the deformation temperature.

In order to prevent that, during opening of the cap, the portion of the upper surface of the shell remains attached to the seal (which, in this way, would undergo an unacceptable deformation), a material is applied on the inner surface of the shell, before the step of making the seal, which is able to favour the detachment of the seal from the upper surface during tearing.

This results in, inevitably, the use of a detaching material and its installation, with the consequent costs and time necessary.

DISCLOSURE OF THE INVENTION

The aim of this invention is to provide a pull-off closure for containers which overcomes the above-mentioned drawbacks of the prior art.

More specifically, the aim of this invention is to provide a pull-off closure for containers which is able to eliminate the use of a detaching material between the seal and the inner surface of the shell.

A further aim of this invention is to provide a pull-off closure for containers having an even more facilitated opening, without modifying the effectiveness of the capping process as such, that is to say, safety in the sealing of the product inside the container.

These aims are fully achieved by the pull-off closure for containers according to the present disclosure.

BRIEF DESCRIPTION OF DRAWINGS

This and other features will become more apparent from the following description of a preferred embodiment of the invention, illustrated by way of non-limiting example in the accompanying tables of drawings, in which.

DETAILED DESCRIPTION OF PREFERRED EMBODIMENTS OF THE INVENTION

With reference to the accompanying drawings, the pull-off closure according to the invention applies to containers having a mouth whose end portion defines an annular collar protruding externally; preferably, the closure is applied to the upper end portion of the neck of a traditional bottle.

The closure comprises an upper portion 1 shaped in the form of a shell which has an upper face 2 from which extends a collar 3 which can be turned over and closed, during capping of the container, beneath the annular collar.

Figure 1:
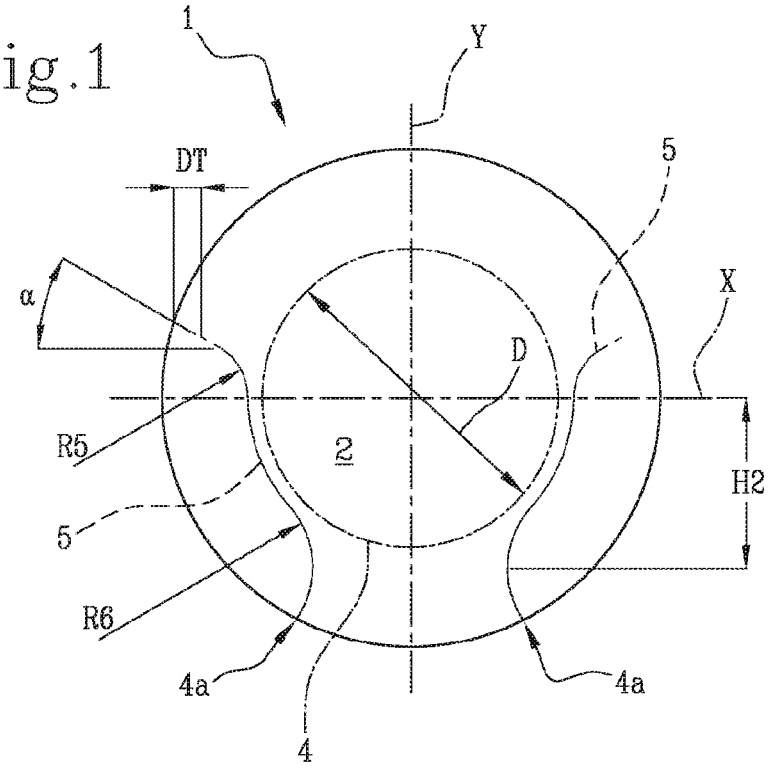
FIG. 1 is a plan view of the shell forming part of the closure according to the invention in the flat configuration.

In effect, the closure originates from a flat metal sheet (preferably aluminium), as shown in FIG. 1, to be deformed to define a flat cylindrical body (also referred to as shell), which is open at the bottom and closed at the top by the upper face 2.

The lower ends of the collar 3, as mentioned above, will undergo, during the capping step, an action of folding inwards so as to stably associate the closure to the collar of the bottle. These operations form part of the prior art.

With regard to the invention in question, the upper face 2 and the collar 3 define, at their connection, an annular edge 4; the latter coincides with the outer circumference of the upper face 2 which has a diameter D. See also FIG. 1 where it is indicated with a dashed line.

The numeral 5 indicates the lines of weakness formed on the upper face 2 and on the collar 3, which define an opening strip 6 which extends in a tab 7 extending beyond the collar 3.

For a central stretch 4*c*, the lines of weakness extend along a circumference outside the surface of the upper face 2.

More precisely, the lines of weakness 5 are made with a punching operation on the material of which the closure is made such as to reduce the thickness by a value which does not affect at all the mechanical seal of the closure itself after the capping operation; at the same time, these lines of weakness allow, during opening—as described in more detail below—a proper pull off of the material of which the closure is made along the lines of weakness.

It should be noted that the lines of weakness 5 are made on the metal shell as internal, and not external, incisions, that is to say, from the side which will be facing, during final use, towards the neck of the bottle.

The numeral 8 denotes a gripping element which can be associated with the tab 7. Preferably, during the formation of the entire closure, the gripping element 8 will be made of plastic material and will be connected to the tab 7 through the agency of respective holes 7*f*.

The gripping element 8 is configured with a distal ring 10.

Figure 2:
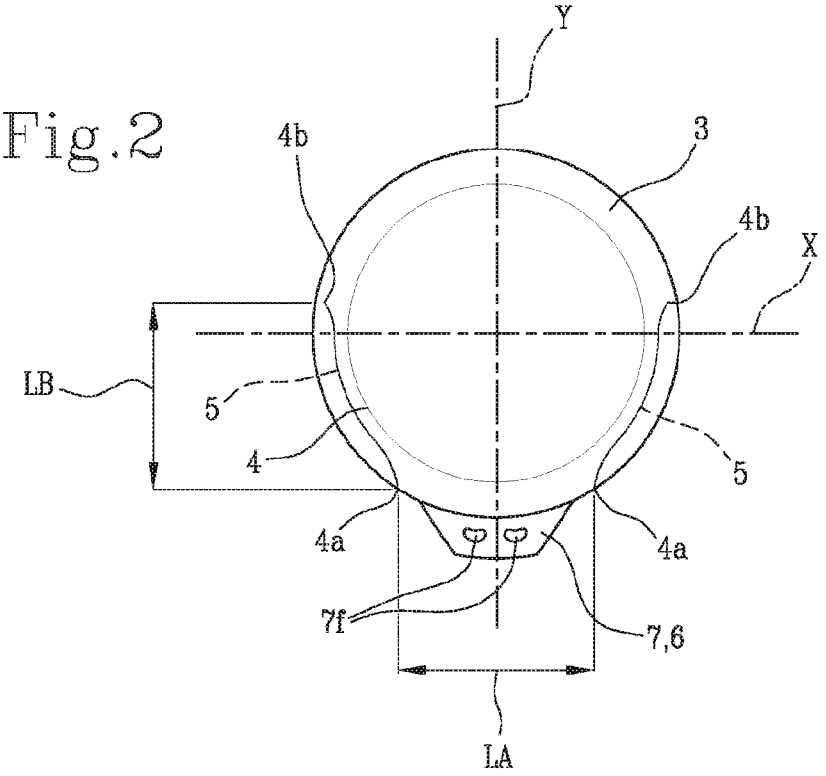
FIG. 2 is a top view of the shell according to this invention in a configuration wherein the collar is turned over and closed on the neck of the container.

As clearly shown in FIGS. 1 and 2, the lines of weakness 5 extend along the collar 3 and the outside the annular edge 4.

More in detail, the lines of weakness 4, which are symmetrical with respect to an axis X at the centre of the tab 7, start from a median end point 4*a* located outside the above-mentioned tab 7 and terminate beyond a second axis Y perpendicular to the previous one, at a transversal end point 4*b*.

The distance between the two median end points 4*a*, measured parallel to the axis X, is equal to the value LA.

The distance between each point of the transversal end 4*b* and the axis X, measured parallel to the axis Y is equal to the value LB.

Preferably, LA/D=0.63.

therefore, preferably LA/D is between 0.5 and 0.7.

Preferably, LB/D=0.135.

therefore, preferably LA/D is between 0.1 and 0.2.

Figure 3:
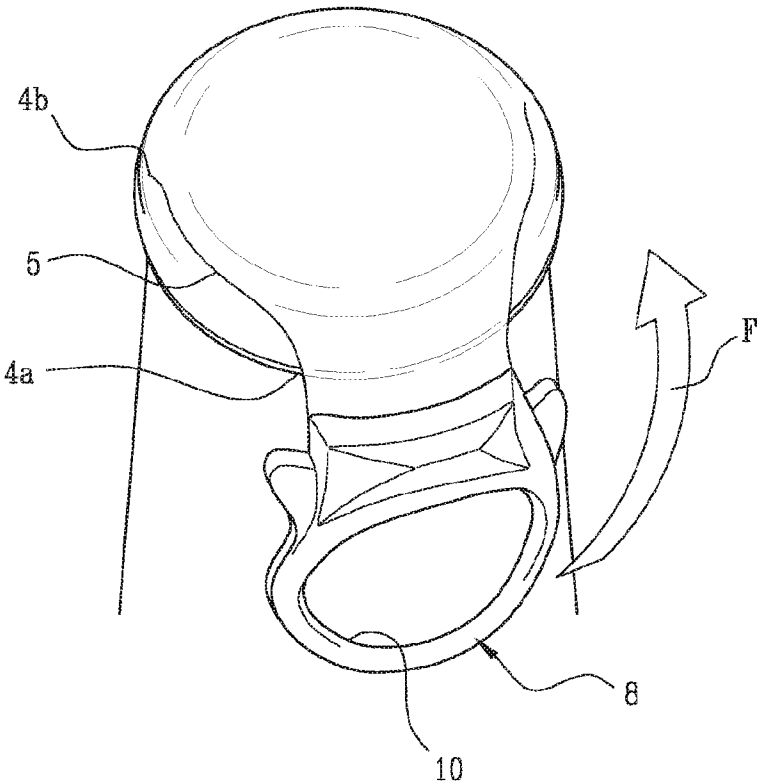
FIG. 3 is a perspective view from above of the closure according to the invention applied to the neck of a container (bottle) in the opening start configuration.

As shown FIG. 3, once the closure in question has been positioned on the neck of the bottle and firmly anchored to it, the gripping element 8 with relative ring 10 lies alongside the neck of the bottle.

During opening, the user will apply a force in the direction of the arrow F in FIG. 3, so as to start to detach the gripping element 8 from the neck, as shown in FIG. 3.

More precisely, the gripping ring 10 is outside the bottle sufficiently for grasping it and it is pulled, horizontally, away from the bottle, breaking the collar 4*a* at the lines of weakness (first opening step).

Continuing with the opening (FIG. 4), the second step comprises a pushing upwards of the ring 10 (with an angle of approximately 120° between the tab and the neck of the bottle), with the consequent breakage of all the remaining portion of the lines of weakness, up to the complete opening of the cap.

It should be noted that, during this step, the seal G facilitates the opening, consequently reducing the forces applied.

It should be noted that, during the opening, the seal G remains attached to the shell 1.

Figure 4:
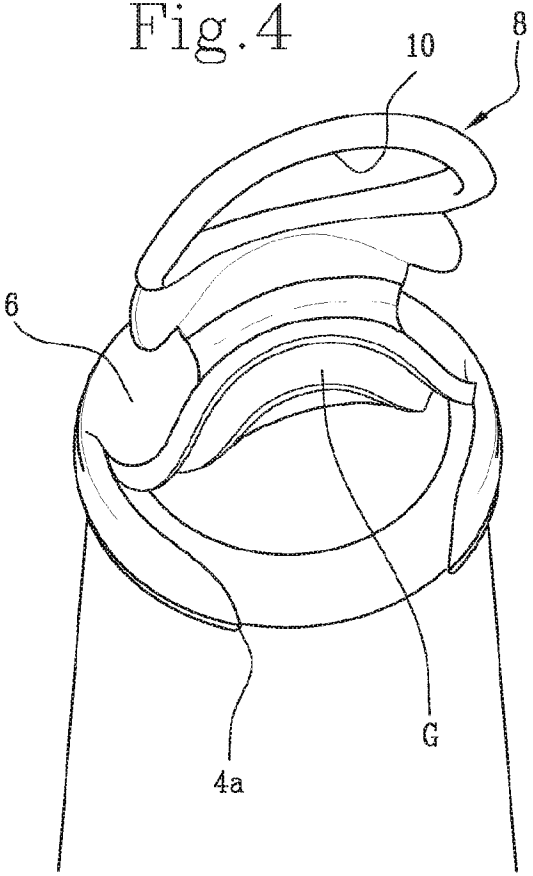
FIG. 4 is a perspective view from above of the closure according to the invention applied to the neck of a container (bottle) in the opening end configuration.

It should be noted how the geometry of the lines of weakness 4—which, as already mentioned, are arranged, for a stretch, along circumferential arcs outside the circumference D of the upper face 2—has an effect on the improved ease in pulling off the strip 6. This is partly due to the fact that the lateral portions of the strip 6 have a sort of rib (due, precisely, to the characteristics of the lines of weakness made outside the upper face); this rib favours a greater rigidity of the strip itself, which, after exceeding the force for breaking the lines of weakness, allows the opening of the closure as illustrated in FIG. 4.

This also means that it is no longer necessary to use detaching products between the strip 6 and the underlying seal G (see also FIG. 4), such as, for example, anti-adhesive paints.

The solution according to this invention therefore achieves the preset aims: easier opening of the closure itself by the operator, on the one hand, and elimination of any detaching product between the inner surface of the shell and the seal of the closure on the neck of the bottle/container.

Some aspects of the shell 1 are described below.

It should be noted that the lines of weakness 5 terminate (points 4*b*) before the outer edge of the shell, as shown in the accompanying drawings.

More specifically, the lines of weakness 5 terminate at a height DT, measured as a projection on the axis X, of between 0.5 mm and 4 mm. more preferably between 1.5 mm and 3 mm.

This favours the detachment of the seal G during the opening of the cap and the maintaining of the seal.

Moreover, this prevents accidental opening of the cap due to the internal pressure in the bottle to which the cap is applied.

It should be noted that the radius R5 indicated in the accompanying drawings is preferably between 3 mm and 5 mm.

It should be noted that the radius R6 indicated in the accompanying drawings is preferably between 4 mm and 8 mm. more preferably between 5 mm and 7 mm.

It should also be noted that, at the start of the lines of weakness (points 4*a*), there is an incision with a reduced depth compared with the remaining zones of the lines of weakness (in the order of, as an absolute quantity, a few hundredths of a mm, preferably less than 0.05 mm, even more preferably less than 0.03 mm).

This favours the optimum seal of the cap.

The height H2 indicates the end of the reduced depth zone (which starts at the point 4*a*).

It should be noted that the height H2 is preferably between 10 mm and 14.5 mm.

With reference to the angle labelled $\alpha$ defined by the tangent to the lines of weakness 5 at the end part and the axis labelled X, it should be noted that the angle is between 0 and 90°, more preferably between 10° and 70°, still more preferably between 20° and 40°.

Figure 5:
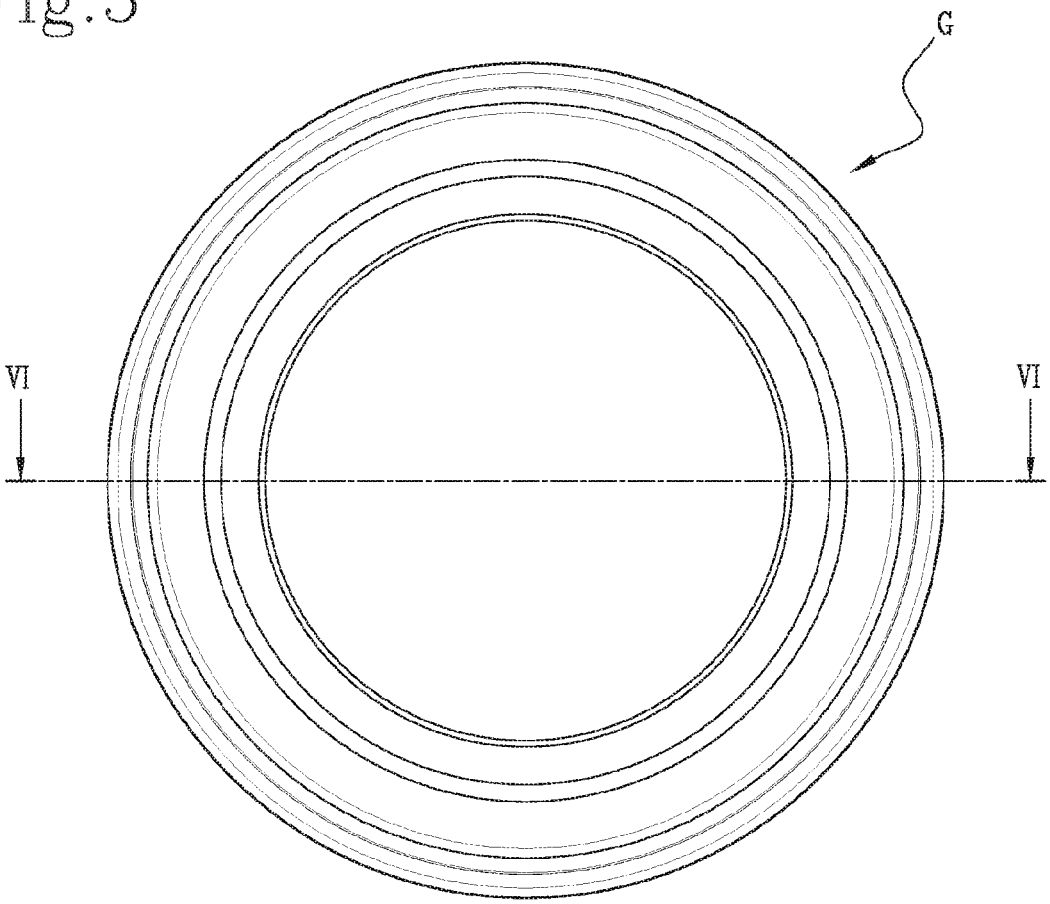
FIGS. 5 and 6 illustrate a seal which is applied to the closure according to the invention.
Figure 6:
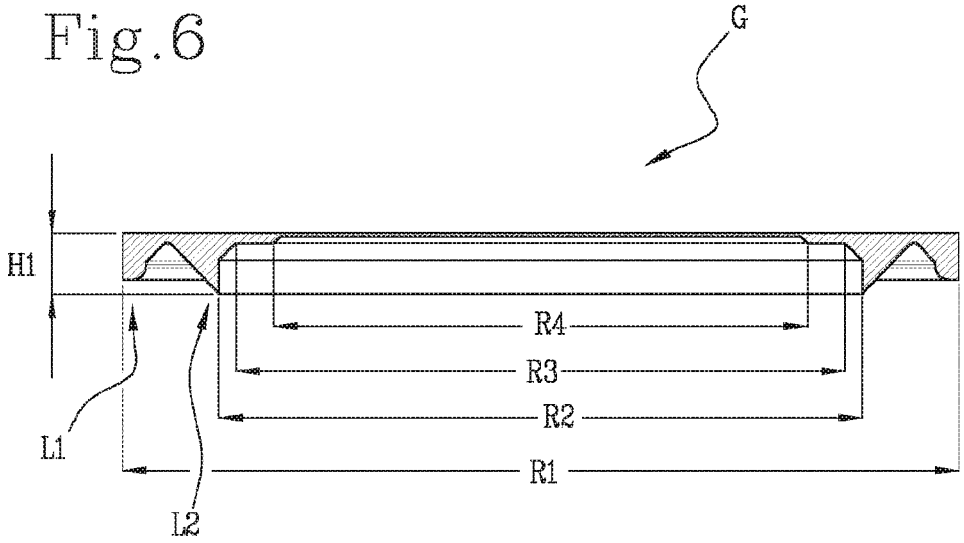

As shown in FIGS. 5 and 6, the seal G is equipped with a double lip, that is to say, a first outer lip L1 and a second inner lip L2.

As shown in FIGS. 4 and 5, the seal has an outer diameter R1 of between 23 mm and 25.5 mm, more preferably between 24 and 25 mm, even more preferably between 24.2 mm and 24.8 mm.

It should be noted that the diameter favours the opening of the cap, since during opening (step 2) the seal G pushes on the walls of the shell.

With reference to the internal diameter of the second lip L2, labelled R2, the diameter is preferably between 18 mm and 21 mm, more preferably between 18.5 mm and 20.5 mm, still more preferably between 18.5 mm and 19.5 mm.

It should be noted that the maximum height H1 of the lips relative to the bottom surface of the seal G, that is to say, the surface which will be in contact with the metal part of the shell, is preferably between 1.5 mm and 2 mm, even more preferably between 1.6 mm and 1.9 mm.

It should be noted that the seal G also has an inner reinforcing ring, which extends between the diameter labelled R3 and the diameter labelled R4.

Preferably, the diameter R3 is between 14 mm and 20 mm, even more preferably between 16 mm and 19 mm.

Preferably, the diameter R4 is between 15 mm and 17 mm, even more preferably between 16 mm and 19 mm.

It should be noted that R4<R3.

The invention claimed is:

1. A pull-off closure for containers having an opening whose end portion defines an annular collar projecting externally; the closure comprising:

an upper portion shaped as a shell having an upper face from which extends a collar, which can be turned over to abut on the annular collar of the container, during capping of the container, the upper face and the collar forming, at a connection thereof, an annular edge;

lines of weakness formed inside on the upper face and on the collar forming an opening strip which extends in a tab extending beyond the collar;

a gripping element associated with the tab, wherein the lines of weakness extend on the collar outside the annular edge;

wherein a ratio between:

a distance between two median end points, proximal to the tab, measured parallel to a first axis passing through a center of the upper face and being parallel to the upper face, and a diameter of the upper face, is between 0.5 and 0.7;

wherein a ratio between:

a distance between two transversal end points, distal from the tab and the first axis, measured parallel to a second axis at right angles to the first axis, the second axis passing through the center and being parallel to the upper face, and the diameter of the upper face, is between 0.1 and 0.2;

wherein the lines of weakness terminate at a height, measured as a projection on the first axis, of between 0.5 mm and 4 mm;

wherein each line of weakness is curved and has a first radius which is between 4 mm and 8 mm;

wherein each line of weakness has a second radius which is between 3 mm and 5 mm.

2. The closure according to claim 1, wherein the lines of weakness extend only on the collar outside the annular edge.

3. The closure according to claim 1, wherein the lines of weakness are symmetrical about the second axis.

4. The closure according to claim 1, wherein the lines of weakness comprise a first and a second line of weakness.

5. The closure according to claim 1, comprising a closing seal positioned inside the upper face.

6. The closure according to claim 1, wherein the lines of weakness start at an edge of the collar and end at a predetermined distance from the edge of the collar.

7. The closure according to claim 1, wherein the lines of weakness have an initial zone with reduced depth.

* * * * *